US007113062B2

(12) United States Patent
Girot et al.

(10) Patent No.: US 7,113,062 B2
(45) Date of Patent: Sep. 26, 2006

(54) ON-BOARD CIRCUIT BREAKER WITH RESET ENABLE MECHANISM

(75) Inventors: Dominique Girot, Clerieux (FR); Thierry Vinard, Chabeuil (FR); Dominique Meux, Valence (FR); Herve Carton, Livron (FR); Thomas Stemmelen, Valence (FR)

(73) Assignee: Crouzet Automatismes, Valence (FR)

( * ) Notice: Subject to any disclaimer, the term of this patent is extended or adjusted under 35 U.S.C. 154(b) by 0 days.

(21) Appl. No.: 11/006,656

(22) Filed: Dec. 8, 2004

(65) Prior Publication Data

US 2005/0134411 A1 Jun. 23, 2005

(30) Foreign Application Priority Data

Dec. 18, 2003 (FR) ..... 03 14903

(51) Int. Cl.
*H01H 73/12* (2006.01)

(52) U.S. Cl. ..... 335/6; 335/13; 335/17; 335/25

(58) Field of Classification Search ..... 335/23–25, 335/35–42, 164–176, 202, 6, 11, 13, 17; 337/67–77

See application file for complete search history.

(56) References Cited

U.S. PATENT DOCUMENTS 3,938,065 A * 2/1976 Ellenberger ..... 335/24
4,837,545 A * 6/1989 Cobb et al. ..... 337/66
5,878,870 A * 3/1999 Ohtaki ..... 200/314
6,642,832 B1 * 11/2003 Pellon et al. ..... 337/666
6,867,670 B1 * 3/2005 McCormick et al. ..... 335/6
2005/0264387 A1 * 12/2005 Bergh et al. ..... 335/130

FOREIGN PATENT DOCUMENTS

EP 1 255 269 A1 11/2002
WO WO 01/97243 A1 12/2001

* cited by examiner

*Primary Examiner*—Ramon M. Barrera
(74) *Attorney, Agent, or Firm*—Steptoe & Johnson LLP

(57) ABSTRACT

An on-board circuit breaker that includes a push-button that enables the circuit breaker to be reset by depressing it, a power supply terminal and distribution terminal, two breaking contacts, and a main bimetal strip. Thermal deformation of the main bimetal strip trips the circuit breaker. The circuit breaker further includes an actuator able to trip the circuit breaker and an electronic circuit monitoring the electric signal. The electric signal is monitored to trip the actuator when predefined particular situations are identified. The circuit breaker also includes a movable reset enable part equipped with a pin. When the circuit breaker is tripped, the reset enable part moves in such a way that resetting the circuit breaker is possible only by depressing the reset enable part before or when the push-button is depressed.

7 Claims, 3 Drawing Sheets

ON-BOARD CIRCUIT BREAKER WITH RESET ENABLE MECHANISM

BACKGROUND OF THE INVENTION

The invention relates to an on-board circuit breaker with a centring key, having a reset enable function.

STATE OF THE ART

Circuit breakers are commonly used that have the function of interrupting an electrical connection when a particular condition is detected. A very large number of breaking conditions can be defined and are known as such.

Different types of circuit breakers exist, the structures and functioning whereof depend on the field of application. Thus, when the circuit breaker is intended for a fixed installation of residential or industrial building type, it is frequently fitted in a cabinet by means of a DIN rail. When the circuit breaker is intended for an on-board system on the other hand, it is in most cases fitted in a panel, whereto it is fixedly secured by means of conventional securing means, correct positioning being ensured by a centring key. Such on-board circuit breakers are perfectly well known as such.

For a long time, circuit breakers used to operate with mechanical means comprising in particular a bimetal strip, deformation whereof caused breaking. Thus when too large a current flowed through the bimetal strip, heating of the bimetal strip performed the breaking function and protected the system. As the technology has progressed, it is now possible to add electronic functions to these mechanical systems whilst preserving the same overall dimensions. These electronic functions enable other particular conditions requiring breaking of the electrical circuit to be detected.

When the circuit breaker performs electrical breaking, there are therefore several possible instances that may arise. It may either involve a case of a break related to a thermal trip or of a break related to a trip on an order from the electronic circuit. Present on-board circuit breakers do not enable the causes of tripping to be differentiated efficiently, in particular as far as the possibility of resetting the device is concerned.

SUMMARY OF THE INVENTION

The object of the invention is therefore to remedy the drawbacks of the state of the art by proposing an on-board circuit breaker with a centring key, having a reset enable function. In case of mechanical tripping, a circuit breaker according to the invention will be able to be reset in the same way as existing devices, however in case of tripping on an order from the electronic circuit on the other hand, it will be necessary to perform an additional enable action. In this way, the distinction between the causes of tripping will be immediate, as resetting will be impossible without having been enabled beforehand.

For this purpose, the object of the invention is to provide an on-board circuit breaker comprising

- A push-button (1) which moves along its axis when the circuit breaker trips and which enables the circuit breaker to be reset by depressing same,
- A centring key (2),
- A power supply terminal (3) and a distribution terminal (4),
- Two breaking contacts (5),
- A main bimetal strip (6) deformation whereof by thermal effect trips the circuit breaker,

- An electronic circuit (14),
- An actuator (15) able to trip the circuit breaker,
- the electronic circuit (14) monitoring the electric signal flowing between the power supply terminal (3) and the distribution terminal (4), in order to send a tripping order to the actuator (15) when predefined particular situations are identified, characterized in that it also comprises a movable reset enable part (18) equipped with a pin (19) and that, when the circuit breaker trips following an order sent by the electronic circuit (14) to the actuator (15), the reset enable part (18) moves in such a way that resetting of the circuit breaker is only possible by depressing the reset enable part before the push-button (1) is depressed or simultaneously with the latter.

According to a particular embodiment, the pin (19) passes through the centring key (2) when the circuit breaker is in the tripped position following an order sent by the electronic circuit (14) to the actuator (15).

According to a particularly advantageous embodiment, the actuator comprises a moving core (17) equipped with a rod securedly fixed to a washer (22) of larger diameter than the rod, the rod and washer (22) operating in conjunction with a recess (21) provided in the reset enable part (18).

Optionally, the on-board circuit breaker comprises auxiliary contacts (12) indicating three different states according to the state of the circuit breaker.

Optionally, the circuit breaker comprises communication means able to transmit information through the push-button. The communication means can comprise a light-emitting diode, possibly emitting in the infrared.

BRIEF DESCRIPTION OF THE DRAWINGS

Other advantages and features will become more clearly apparent from the following description of a particular embodiment of the invention, given as a non-restrictive example only and represented in the accompanying drawings in which.

DETAILED DESCRIPTION OF AN EMBODIMENT

Figure 1:
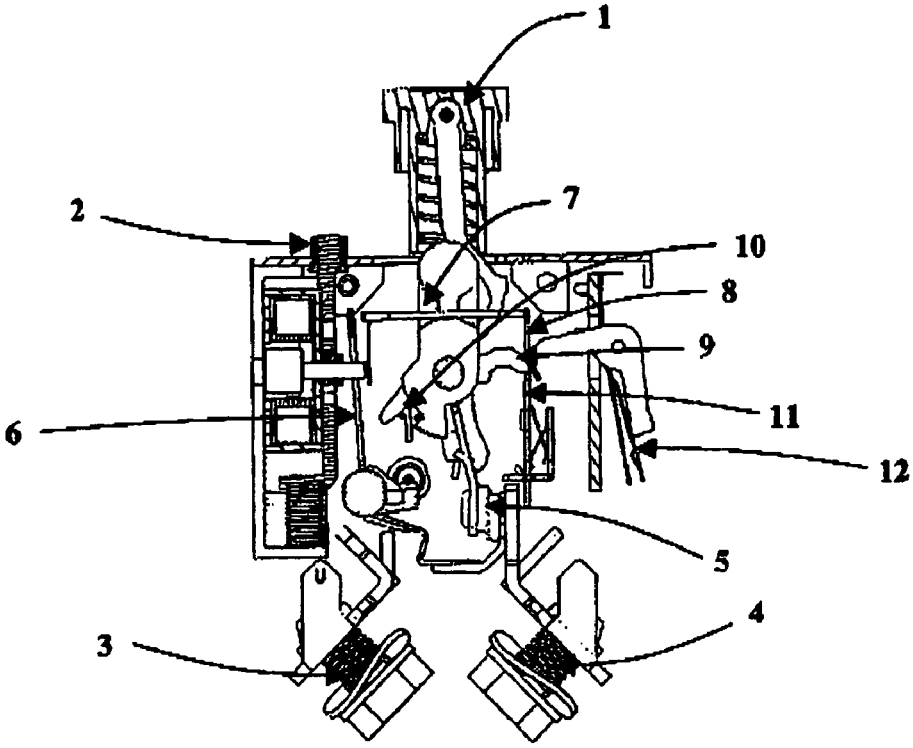
FIG. 1 represents a circuit breaker according to the invention in the set position.
Figure 2:
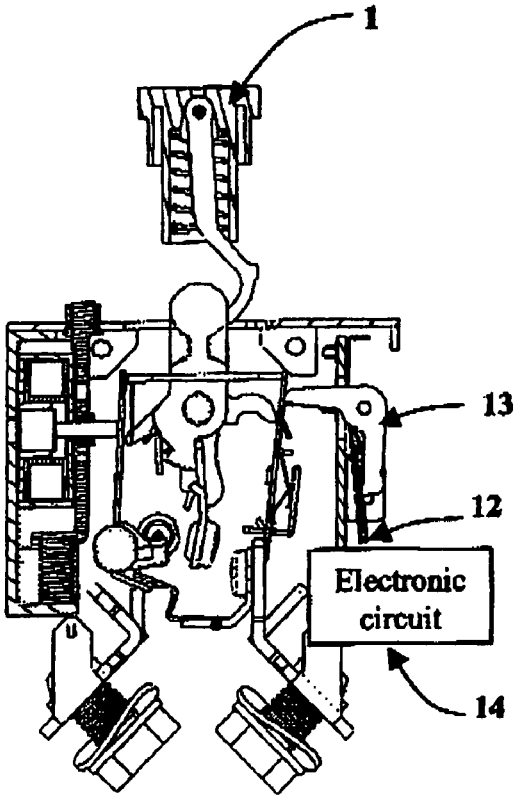
FIG. 2 represents a circuit breaker according to the invention in the tripped position after thermal deformation of a main bimetal strip.

FIG. 1 represents an on-board circuit breaker with a centring key according to the invention in the set position. When it is fitted, a circuit breaker of this type is fixedly secured to a panel by tightening a nut that presses the panel onto a metal conducting plate forming a ground. An actuating push-button (1) passes through the panel and a centring key (2) enables correct positioning of the device to be ensured. In the embodiment of implementation of the invention represented in FIG. 1, the on-board circuit breaker comprises in conventional manner a power supply terminal (3) and a distribution terminal (4) and two breaking contacts (5). When the circuit is made, the two breaking contacts (5)

establish an electrical connection in such a way that an electrical current can flow freely between the two terminals (3, 4). In conventional manner, a main bimetal strip (6) causes opening of the circuit by deforming by heating. The deformation of the bimetal strip (6) is transmitted by the connecting strip (7) and moves the slide (8) until the latch (9) is released. When the latch (9) is released, the breaking contacts (5) are separated due to the effect of a spring mechanism (10), and the button (1) moves along its axis under the effect of a spring, moving away from the terminals (3, 4). FIG. 2 represents a circuit breaker according to the invention in the tripped position by thermal deformation of the main bimetal strip (6).

The device represented in FIG. 1 also comprises a compensation bimetal strip (11) the function whereof is to compensate for the temperature variation of the environment, i.e. the temperature variations that are not related to the electric current and that therefore do not have to be taken into account to trip. This system is known as such and is optional. In fact, the invention operates both for switchgear devices not equipped with compensation bimetal strips and for switchgear devices equipped therewith such as the one represented in FIG. 1. Thus the presence of a compensation bimetal strip is neither essential for implementation of the invention nor made impossible by the latter.

In conventional manner, depressing the button (1) to its initial position will re-establish the electrical connection between the two breaking contacts (5) and place the latch (9) back in the slide (8). If the main bimetal strip (6) is no longer deformed, the latch (9) will be held in place by the slide (8) and the device will be reset.

The operation described up to now is identical in all points to that of an on-board circuit breaker according to the prior art. Likewise, the device represented is equipped with a system of auxiliary contacts (12), known as such but optional. When the circuit breaker is set, the auxiliary contacts (12) are open, and when the circuit breaker triggers opening of the breaking contacts, the lever (13) swivels and comes and closes the auxiliary contacts (12). This optional two-state auxiliary contact system enables the state of the circuit breaker to be checked easily and is perfectly compatible with the invention.

The circuit breaker is equipped with an electronic circuit (14) that is electrically connected to the metal plate forming the ground and that measures the characteristics of the current flowing in the device, for example at the level of the main bimetal strip (6). In conventional manner, the electronic circuit (14) is able to detect particular situations requiring tripping of the circuit breaker which comprises for this purpose an actuator (15) that releases the latch (9) on an order from the electronic circuit (14). In the embodiment of the invention represented in the figures, the actuator comprises an electromagnet (16) enabling a core (17) to be moved. The core is equipped with an actuating rod that presses on a flange (18) fixedly secured to the connecting strip (7) in such a way that any movement of the core (17) causes movement of the connecting strip (7) until the latch (9) is released.

The electronic circuit (14), when monitoring the characteristics of the electrical signal, is able to detect instantaneous phenomena that do not accumulate sufficient mean energy for the main bimetal strip (6) to trip the circuit breaker. This may for example involve bad contacts or electric arcs. Some of these phenomena present fire hazards. This is why it is preferable to indicate clearly what was the cause of tripping and to prevent any involuntary resetting.

Figure 3:
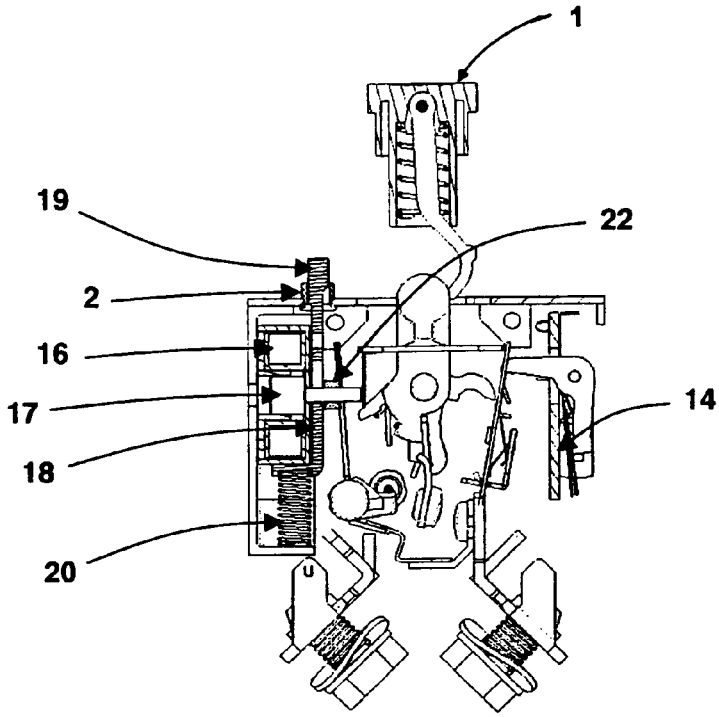
FIG. 3 represents a circuit breaker according to the invention in the tripped position after use of an actuator.
Figure 4A:
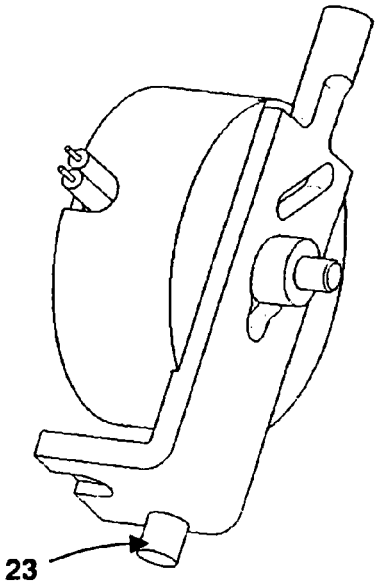
FIGS. 4*a* and 4*b* represent a mechanical sub-assembly, the positions whereof correspond respectively to FIGS. 1 and 3.
Figure 4B:
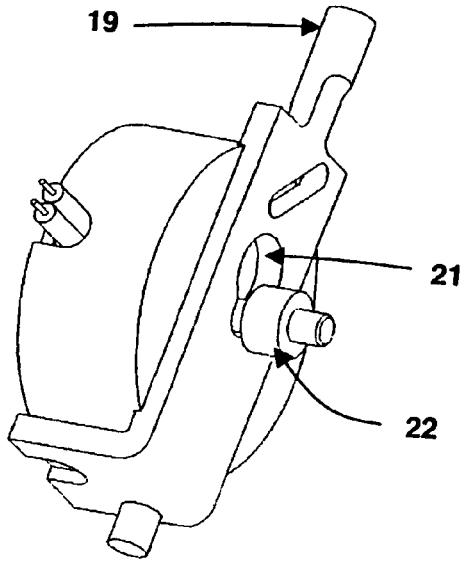

For this purpose, the circuit breaker according to the invention comprises a reset enable part (18) equipped with a pin (19). When the actuator (15) is activated on an order from the electronic circuit (14), the reset enable part (18) moves due to the effect of a compression spring (20) and prevents the core (17) from returning to its initial position. The pin (19) protrudes out through the centring key (2) as represented in FIG. 3. FIGS. 4*a* and 4*b* represent an embodiment of the reset enable device according to the invention respectively in the set position and in the tripped position on an order from the electronic circuit (14). In this embodiment, the actuating rod of the core (17) is securedly fixed to a washer (22) the diameter whereof is larger than that of the actuating rod of the core (17). The reset enable part comprises a recess (21) a part whereof lets the washer (22) pass so that the core (17) is in the set position, and another part whereof only lets the actuating rod of the core (17) pass but not the washer (22) so as to keep the circuit breaker in the tripped position. In case of tripping on an order from the electronic circuit (14), it is necessary to depress not only the push-button (1) but also the reset enable part (18) by pressing on the pin (19). It is thus materially impossible to reset the device without being informed of the type of trip.

In addition as the pin (19) of the reset enable part (18) passes through the centring key (2) and the latter is already present on devices according to the prior art, the device according to the invention is perfectly compatible and can replace a device according to the prior art without having to modify the panel.

The reset enable part (18) is an additional safety device which does not add any risk of failure of the circuit breaker. Even if the reset enable part (18) is blocked, tripping does in fact remain possible both by deformation of the main bimetal strip (6) and on an order from the electronic circuit (14).

According to a particularly advantageous embodiment of the invention, the reset enable part (18) enables the electronic tripping system to be tested. The electronic circuit (14) in fact continuously monitors the characteristics of the current. Thus, if an operator pulls on the button (1) and trips the circuit breaker manually, the electronic circuit (14) knows that the current was insufficient to deform the bimetal strip (6). The electronic circuit (14) then orders the actuator (15) to trip, which causes the core (17) to move and the pin (19) to come out of the reset enable part (18) through the centring key (2). The pin (19) coming out validates correct operation of the electronic tripping system.

Figure 5:
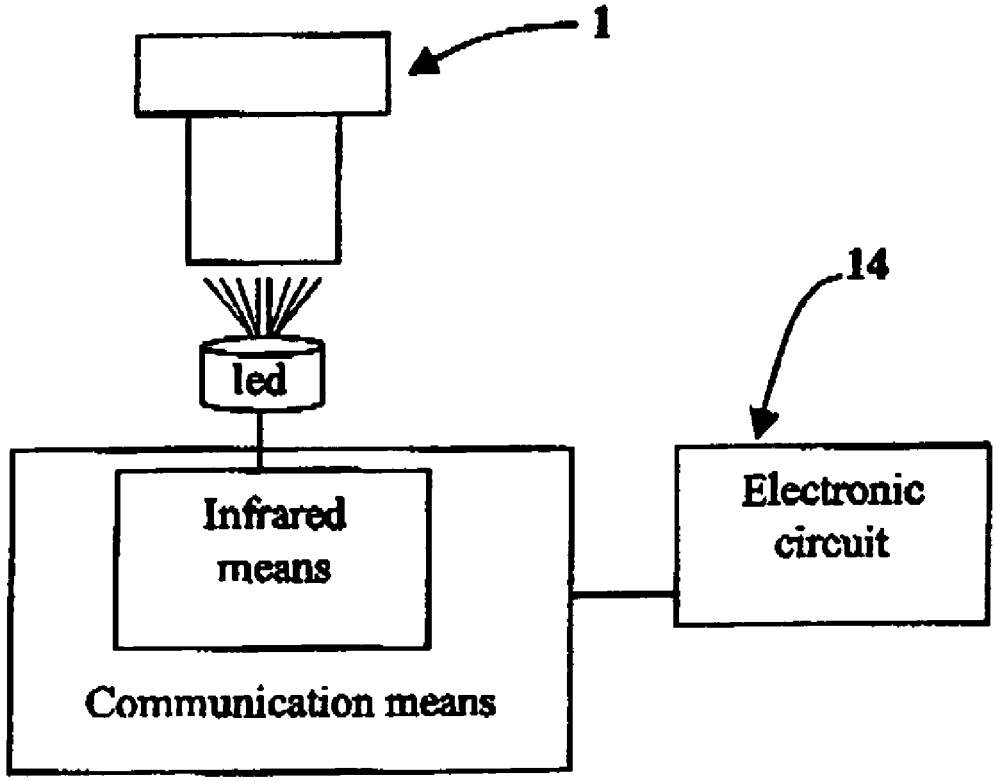
FIG. 5 illustrates infrared means, communication means, and an electric circuit of the invention.

In the case where the circuit breaker is equipped with an optional system of auxiliary contacts (12), as represented in the figures, the reset enable part (18) is equipped with a spigot (23) which closes a contact. When tripping of the circuit breaker takes place on an order from the electronic circuit (14), the reset enable part (18) moves due to the effect of the spring (20) and the contact opens, which has the effect of modifying the apparent impedance at the terminals of the auxiliary contacts (12) and of thus establishing a third state. In this way it is possible to check the state of the circuit breaker and, if it is in the tripped state, to know what the tripping mode was. =p According to a particularly advantageous embodiment of the invention, shown in figure 5, the circuit breaker according to the invention is also able to converse. In this embodiment, the button (1) is transparent and the circuit breaker comprises a controlled light-emitting diode so as to transmit information. This information can for example, concern the state of the electrical system, the state of a device, a description of the context when tripping occurs or any other data known by the electronic circuit (14).

According to the context of use of the circuit breaker, the light-emitting diode can emit in the visible spectrum or in the invisible spectrum, for example in the infrared. The second solution enables the personnel not to be perturbed, for example the personnel flying an aeroplane. The first solution is compatible with a fleeting flashing standby system indicating that the switchgear device is supplied and in operation, the diode only being out when the switchgear device is no longer supplied or when the electronic circuit or the diode itself are faulty.

By using the transparent button (1) through which the signal is transmitted, reading of the signal is made particularly easy. The button can in fact very easily be connected to a portable reading system, for example by means of a cap, thus preventing any transmission error.

It is also possible to set up a two-way transmission, using for example infrared transmission in one direction and transmission in the visible spectrum in the other direction.

The invention claimed is:

1. An on-board circuit breaker, comprising:

A push-button which moves along its axis when the circuit breaker trips, a centering key, a power supply terminal, a distribution terminal, a breaking contact, a main bimetal strip, thermal deformation of said main bimetal strip trips the circuit breaker, an actuator able to trip the circuit breaker, an n electronic circuit that monitors the electric signal flowing between the power supply terminal and the distribution terminal, so that said electronic circuit causes the actuator to trip the circuit breaker when predefined particular situations are identified, a movable reset enable part equipped with a pin and that when the circuit breaker is tripped by the electronic circuit and the actuator, the reset enable part moves in such a way that resetting of the circuit breaker is only possible by depressing the reset enable part before or simultaneously with depressing the push-button.

2. The on-board circuit breaker according to claim 1, wherein the pin passes through the centering key when the circuit breaker is in the tripped position following an order sent by the electronic circuit to the actuator.

3. The on-board circuit breaker according to claim 1, wherein the actuator comprises a moving core equipped with a rod securely fixed to a washer of larger diameter than the rod, the rod and washer operating in conjunction with a recess provided in the reset enable part.

4. The on-board circuit breaker according to claim 1, wherein auxiliary contacts indicate three different states according to the state of the circuit breaker.

5. The on-board circuit breaker according to claim 1, wherein the push-button is transparent and the circuit breaker comprises communication means able to transmit information through the push-button.

6. The on-board circuit breaker according claim 5, wherein the communication means comprise a light-emitting diode.

7. The on-board circuit breaker according claim 6, wherein the light-emitting diode emits in the infrared.

* * * * *